United States Patent [19]

Rollins et al.

[11] 4,121,880

[45] Oct. 24, 1978

[54] ELONGATE ELECTRICAL CONNECTOR RETAINING DEVICE

[75] Inventors: David M. Rollins, Monroe; Scott P. Masonholder, Everett, both of Wash.

[73] Assignee: Tel-Tone Corporation, Kirkland, Wash.

[21] Appl. No.: 796,236

[22] Filed: May 12, 1977

[51] Int. Cl.[2] ..... H01R 13/54

[52] U.S. Cl. ..... 339/119 R; 24/16 PB; 248/74 PB; 339/75 M; 339/104

[58] Field of Search ..... 339/75 R, 75 M, 75 P, 339/91 R, 103, 104, 119; 24/16 PB, 73 AP, 73 PB, 73 SA, 213 CS, 208 H; 248/74 B, 74 PB; 174/138 G

[56] References Cited

U.S. PATENT DOCUMENTS 3,152,219 10/1964 Murray et al. ..... 24/16 PB X

FOREIGN PATENT DOCUMENTS 2,358,234 6/1974 Fed. Rep. of Germany ..... 339/103 M

*Primary Examiner*—Roy Lake
*Assistant Examiner*—E. F. Desmond
*Attorney, Agent, or Firm*—Christensen, O'Connor, Johnson & Kindness

[57] ABSTRACT

An electrical connector retaining device for retaining the male and female members of an elongate electrical cable connector in their mated positions is disclosed. The retaining device includes a semi-resilient strap and a rigid frame. The strap includes a planar region and one or more anchoring prongs having bullet shaped ends integrally formed with the planar region and projcting outwardly from on edge thereof. Extending obliquely outwardly from the edge of the planar region opposed to the prong edge is a flange. The flange is integrally formed with the planar region and includes a plurality of ridges that lie parallel to the edge from which the flange extends. The rigid frame may be integrally formed in the housing or chassis of an electrical subsystem, or as a separate item. The rigid frame includes an aperture in which one element (e.g., male or female) of the connector is mounted. That element is attached to the rigid frame. Located in the rigid frame, along one of the longitudinal sides of the aperture are holes adapted to receive the anchoring prongs. On the opposite side of the aperture is a slot and one or more cross-bars adapted to receive and interact with the ridges formed in the strap flange when the strap is wrapped over the assembled connector. The cross-bars may be located in an integral flange lying transverse to the plane of the portion of the rigid frame supporting the connector element. A multitude of cross-bars form a ladder arrangement that interacts with a number of ridges, rather than a single ridge.

33 Claims, 6 Drawing Figures

Fig. 1.
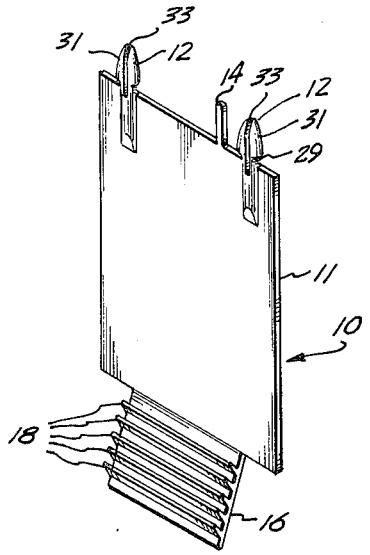
Fig. 2.
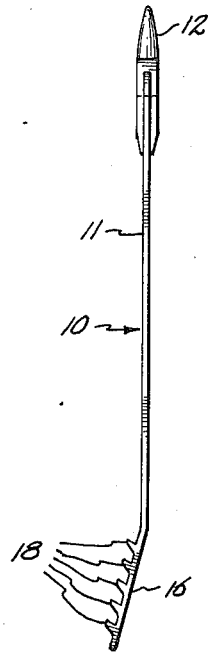
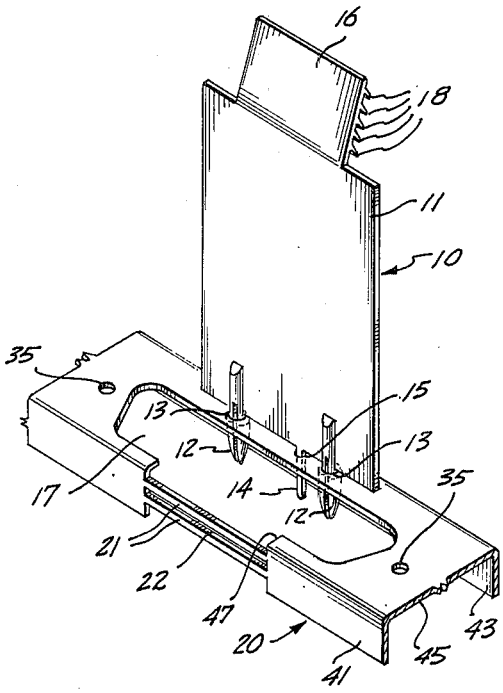
Fig. 3.
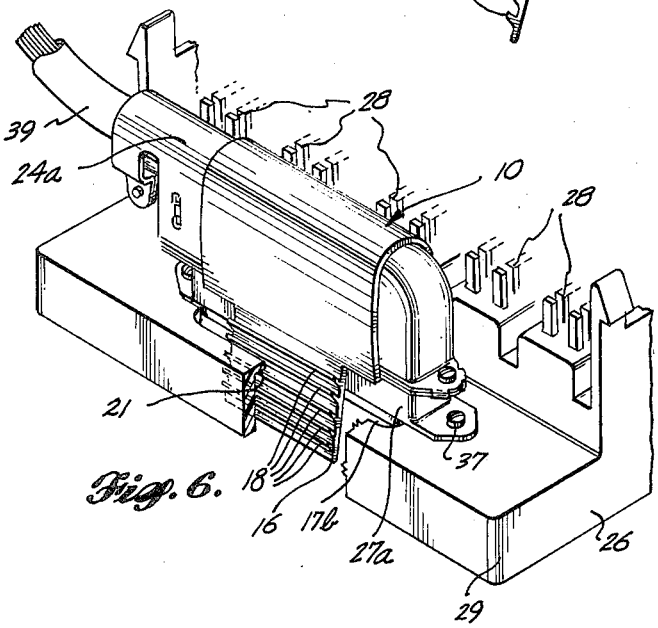
Fig. 6.
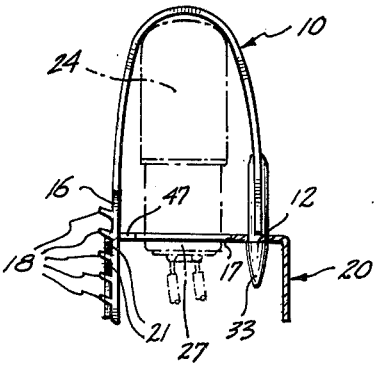
Fig. 4.
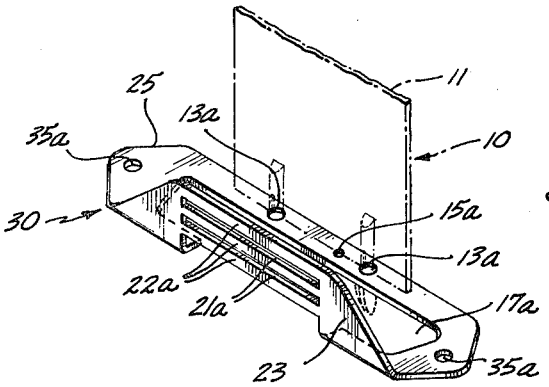
Fig. 5.

ELONGATE ELECTRICAL CONNECTOR RETAINING DEVICE

BACKGROUND OF THE INVENTION

This invention relates to devices for securing or retaining cable connectors in their mated positions to prevent accidental disconnection and, more particularly, it relates to devices for retaining elongate cable connectors in their mated positions.

Electrical cable connectors are well-known and widely used in electronic systems to connect various subsystems together. Such electrical connectors are often elongate and formed such that a row or a plurality of rows of contact elements are joined when the male and female elements of an overall connector are mated. In some connectors, electrical connection is made by male pins mating with corresponding female apertures. In other connectors, an elongate island in the male element supports a row or a pair of rows of side-by-side mounted ribbon-like contacts. The male ribbon contacts mate with corresponding female ribbon contacts mounted side-by-side in an island receiving aperture formed in the female element. Usually the ribbons or pins lie along axes that are orthogonal to the longitudinal axis of the overall connector elements. And, usually, the cables enter the connector elements at one end. Prior art connectors formed in these and similar manners can make 50 or more separate electrical connections when the male and female elements are mated together. Such connectors are sold by Bunker Ramo Corporation of Oakbrook, IL 60521 under the trademark AMPHENOL and by Amp, Inc. of Harrisburg, PA 17105 under the trademark CHAMP. Other companies sell similar types of electrical connectors. These elongate electrical cable connectors are sometimes generically referred to as ribbon connectors. The invention was developed for use in conjunction with such connectors.

It is often necessary to secure elongate electrical cable connectors after the male and female elements are mated to prevent accidental disconnection. Previously, one common method of securing connectors used screws to clamp the fingers of the male and female elements together, or to clamp the elements to a circuit board or mounting panel receptacle. While this technique secures the connection, it has a number of disadvantages, particularly when used in a situation in which the connector elements are to be disconnected from time to time. Specifically, the fastening and unfastening of screws is a time-consuming, tedious process and, therefore, undesirable. Also, because of the generally small size of the screws used, it is easy to both strip the threads of the screws and lose screws. Even the use of a captive type screw is not entirely foolproof. Further, because of the space constraints in many locations, it is difficult to obtain easy access to connector screws using a screwdriver or other tool. The present invention is directed to providing an elongate electrical cable connector retaining device that overcomes these disadvantages.

More specifically, it is an object of this invention to provide a device for retaining elongate electrical cable connectors in their mated position.

A further object of this invention is to provide elongate electrical cable connector retaining devices which do not require screws and, which are inexpensive to manufacture and easy to install.

A still further object of this invention is to provide electrical connector retaining devices suitable for use with present forms of commercially available elongate electrical cable connectors without modification to the connectors.

SUMMARY OF THE INVENTION

In accordance with this invention retaining devices for elongate electrical connectors are provided. In their preferred form, retaining devices formed in accordance with the invention include a semi-resilient strap and a rigid frame. The strap includes a planar region having opposing edges. One or more integrally formed anchoring prongs project outwardly from one edge of the planar region, in the plane of the planar region. Extending outwardly from the other edge of the planar region is an integral flange. The flange includes several parallel ridges on one face that lie parallel to the edge of the planar region from which the flange extends. When viewed in cross section the ridges define right triangles. Preferably, the ridged flange lies in a plane oblique to the planar region. Also, preferably, each anchoring prong has a bullet-shaped outer end that is spaced from the related edge of the planar region such that a notch is formed between the bullet shaped end and the related edge of the planar region. Further, preferably, each prong has a slot cut longitudinally down its center whereby each prong is formed of two spaced halves.

The rigid frame may be integrally formed in a structure adapted to support the connector. For example, the rigid frame may be integrally formed in the backwall of a cabinet adapted to house an electronic susbsytem; or the rigid frame may be formed in the chassis of an electrical subassembly or device. Further, the rigid frame may be integrally formed as part of a connector block. Alternatively, when the connector is to be used to join two cables, rather than a cable to an electrical subsystem, the rigid frame may be formed as a discrete item. Regardless of how formed, the rigid frame includes an elongate aperture in which one of the elongate connector elements (e.g., either the female element or the male element) is mounted. Formed in the rigid frame along one longitudinal side of the elongate aperture are holes adapted to receive the anchoring prongs. Formed in the rigid frame on the longitudinal side of the connector aperture is a slot adapted to receive the ridged flange of the strap. The rigid frame includes one or more cross-bars adajcent to the slot and adapted to coact with one or more of the ridges of the strap flange. The cross-bars may be formed by an undercut region in an orthogonal wall adjacent to the slot or by a series of slots formed in a wall adjacent to the flange receiving slot, depending upon the nature of the item within which the rigid frame is integrally formed. When the rigid frame is a discrete item, the cross-bars are preferably formed in a flange lying orthogonal to the plane within which the connector aperture is formed.

The semi-resilient strap is attached to the rigid frame by forcing the anchoring prongs into the holes. As the prongs are forced into the holes, the two halves of each prong move toward one another, i.e., the prong compresses. When the bullet-shaped end has passed through the hole, and the notch is reached, the prongs spring open and anchor the strap. In this manner, the strap is affixed by the anchor prongs to the rigid frame. After a connector element is mated to the connector element mounted in the aperture in the rigid frame, the strap is wrapped or folded about the assembled connector and the ridged flange is inserted into the slot located on the opposing side of the assembled connector. When the strap is released the ridges engage the cross-bar or cross-bars, whereby the strap is retained in its folded shape. This engagement occurs because the semi-resilient strap attempts to return to its planar shape after being released, whereby the ridges engage the cross-bar or cross-bars.

When it is desired to remove the strap, the sides of the folded strap are pressed toward one another such that the ridges are disengaged from the cross-bars. Then the strap flange is withdrawn from the flange receiving slot.

Preferably the strap is formed of a nonconductive material such as virgin nylon or nylon with up to a 5% glass fiber filler. Also, preferably, an alignment or positioning prong integrally formed with the planar region projects outwardly from the planar region, in the plane of the planar region and from the edge from which the anchoring prongs project. The positioning prong is adapted to enter a corresponding hole formed in the rigid frame adjacent the prong holes. The positioning prong and its corresponding hole is positioned such that the anchoring prongs must be inserted in their respective holes so that ridges face away from the connector aperture.

It will be appreciated from the foregoing summary that the invention provides a retaining or securing device suitable for use with elongate electrical conductors that overcomes the disadvantages of prior art screw type coupling mechanisms, discussed above. Moreover, the retaining device of the invention has additional advantages. For example, the retaining device of the invention does not require the use of tools, such as screwdrivers. Since the strap is anchored at one end, it will not be lost while it is in an open position. Moreover, should the anchor posts break off, a strap can be readily and quickly replaced. Also fastening and unfastening of the retaining strap can be easily performed using one hand. Thus, the invention is particularly suitable for use in situations where the connector is to be mounted in a marginally accessible location. Finally, because the strap is made of a nonelectrical material, it cannot inadvertently cause electrical shorts should it come in contact with the contacts of an electrical connector element.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIG. 1 is a perspective view of a semi-resilient strap formed in accordance with the invention;

FIG. 2 is a side elevational view of the strap illustrated in FIG. 1;

FIG. 3 is a perspective view of a strap formed in accordance with the invention in a non-retaining position anchored to a rigid frame forming a portion of an electrical subsystem housing;

FIG. 4 is a side elevational view, partially in cross section, of the retaining device illustrated in FIG. 3, showing the strap in a retaining position;

FIG. 5 is a perspective view of a retaining device formed in accordance with the invention suitable for securely connecting a pair of connector elements neither of which is supported by a housing or other assembly; and, FIG. 6 is a perspective view of the retaining device formed in accordance with the invention in combination with a connector block including a plurality of quick connector blades.

DESCRIPTION OF THE PREFERRED EMBODIMENTS

FIG. 1 illustrates a preferred embodiment of a retaining strap 10 formed in accordance with the invention. The strap 10 is an integral element formed of a suitable semi-rigid material, such as virgin nylon or nylon with up to a 5% glass fiber filler, processed in the manner hereinafter described. The strap includes a planar region 11, one or more anchoring prongs 12, a positioning prong 14 and a flange 16. The planar region is illustrated as rectangular and, thus, has two opposing edges. The anchoring prongs 12 and the positioning prong 14 project outwardly from a common opposing edge of the planar region 11, in the plane of the planar region 11. The flange 16 projects obliquely outwardly from the other opposing edge of the planar region.

Each anchoring prong 12 has a bullet-shaped outer end 31 that is spaced from the edge of the planar region from which the anchoring prongs project. Thus, a notch 29 is formed between the bullet-shaped ends 31 and the adjacent edge of the planar region 11. Each anchoring prong is formed of two halves created by a slot cut longitudinally down the center of the anchoring prong 12. The slots extend slightly into the planar region 11. In addition, the planar region is thicker or enlarged in the region where the planar region is aligned with the anchoring prongs 12, for reinforcement purposes.

Preferably, the flange 16 is narrower than the planar region 11. As noted above, the flange 16 projects outwardly form the plane of the planar region 11 at an oblique angle. Formed in the outer face (e.g., the face defined by the obtuse angle formed between the planar region 11 and the flange 16) are a plurality of parallel ridges 18. The ridges 18 are elongate and lie along axes lying parallel to the edge from which the flange 16 projects. Preferably the ridges are right triangular in cross section with a right angle facing the edge of the planar region 11 from which the flange 16 projects.

Preferably, the strap is injected molded of virgin colorless nylon or nylon with up to a 5% glass fiber filler. After a strap is removed from a suitable mold, while it is still hot, the ridged flange 16 is set at 30° and the strap is cooled. The strap is then boiled in water containing Rit dye for a minimum of 2 hours. The purpose of boiling the strap in Rit dye is to force the color into the strap as well as anneal the nylon so that it is stronger.

In addition to the strap, a retaining device formed in accordance with the invention also includes a rigid frame. The rigid frame may be an integral part of another structure or it may be separately formed as a discrete item. FIGS. 3 and 4 illustrate a rigid frame forming a portion of the wall of the chassis or housing of an electronic subsystem. FIG. 5 illustrates a rigid frame formed as a discrete item. FIG. 6 illustrates the rigid frame forming a portion of a connector block including quick connector blades. Regardless of how formed, i.e., integral or separate, the rigid frame includes common and discrete items. These items include: an aperture within which one element, (e.g., male or female) of an elongate electrical cable connector is mounted; holes located along one longitudinal side of the aperture for receiving the anchoring prongs 12 and the positioning prong 14; a slot located along the opposing side of the aperture for receiving the strap flange 16; and one or more cross bars, located in a wall orthogonal to the plane in which the connector element is mounted, adapted to interact with the ridges 18 of the strap flange 16.

FIGS. 3 and 4 illustrate the rigid frame formed as an integral portion of the rear wall of a chassis or housing of an electronic subsystem. The rear wall is depicted as a channel 20. Thus, the rear wall includes a pair of legs 41 and 43 and a cross member 45. Formed in the cross member 45 of the channel 20 is an elongate aperture 17 suitable for receiving one element of a connector (see FIG. 4). The element, which may be a male or female element, is attached to the channel by bolts, rivets or screws that pass through apertures in flanges that project outwardly from the connector and holes 35 located in the channel cross member 45 on opposing ends of the elongate aperture 17. Formed in the cross-member of the channel along one longitudinal side of the elongate aperture 17 are three holes. The spacing between two of these holes 13 is equal to the spacing between the anchoring prongs 12. The diameter of the holes is slightly larger than the diameter of the anchoring prongs in the region of the notches 29. The third hole 15 is spaced such that it will receive the positioning prong 14 when the strap is positioned such that the ridges 18 face away from the elongate aperture 17. This orientation is accomplished by simply locating the positioning prong 14 and its related hole nearer to one of the anchoring prongs than to the other anchoring prong and its related hole.

The strap 10 is inserted by aligning the anchoring prongs and the positioning prong with their related holes and pressing the prongs into their related holes. Since the anchoring prongs are split, they are compressed when they are pressed into their related holes. An adequate amount of pressure forces the prongs to a point where the bullet-shaped ends 31 lie beyond the other (inner) surface of the cross member 45 of the channel 20. When this point is reached, the compressed prongs expand and anchor the strap, as best illustrated in FIG. 4. Of course, the width of the notches 29 is generally equal to the thickness of the cross-member 45.

Formed in the cross-member 45 of the channel 20 along the other longitudinal side of the elongate aperture 17 is a strap slot 47 for receiving the flange 16 of the strap 10. The slot is formed by removing the entire portion of the cross-member from the elongate aperture 17 to the adjacent leg 41 of the channel 20. Formed in the same leg 41 of the channel 20 are a plurality of cross-bars 21 separated by slots 22. The strap slot 47, and the cross-bars 21 and slots 22, are equal in length to the width of the flange 16 of the strap 10. The leg slots and the cross-bars form a ladder-like arrangement. The cross-bars are spaced from one another by a distance adequate to allow a ridge 18 to enter the slot formed by the spacing between a pair of adjacent cross-bars. Thus, when an anchored strap is folded over such that the flange 16 can be inserted into the strap slot 47, and then released, the ridges 18 will enter the slots between the cross-bars 21 and latch the strap in place. In this regard, it is pointed out that, as discussed above, the strap is semi-resilient. As such the strap includes springback that tends to return it to its planar condition when unrestrained. It is this springback that tends to press the ridges 18 into the slots 22 between the cross-bars 21 after the strap is folded over, the flange is inserted into the strap slot 47 and then the strap is released. Since springback also tends to withdraw the strap flange 16 from the strap slot 47, a constant pressure that keeps the ridges engaging the cross-bars is created.

FIG. 4 illustrates a connector mounted and restrained by the restraining device of the invention. More specifically, FIG. 4 illustrates an elongate cable connector element 27 mounted in the aperture 17. The elongate cable connector element may be either the male or the female element of a composite connector assembly. Mated to the thusly mounted connector element 27 is a detachable mating connector element 24. The strap 10 is illustrated as folded over the backside of the mating connector element 24 such that the flange 16 lies in the strap slot 47. One ridge 18 lies in a slot 22 formed between the two illustrated cross-bars 21. Another ridge lies beneath the lower cross-bar.

Removal of the strap is achieved by pressing the folded (ridged) side of the strap toward the connector, whereby the ridges 18 are disengaged from the slots 22, and withdrawing the flange from the strap slot 47. As a result of the resiliency of the strap 10, after it is released, it will attempt to achieve its original planar shape, illustrated in FIG. 3. This planar shape will not be fully achieved because the material will have received some "set" while it was in the restraining position illustrated in FIG. 4.

The inclusion of several ridges 18 allows the strap to be used on different size connectors and still tightly retain the connectors in their mated position. This is achieved without the strap bending inwardly and losing contact with the cross-bars, as might occur if the flange 16 were not made oblique to the planar region 11. More specifically, if the flange 16 were co-planar with the planar region 11, the flange 16 would tend to curve inwardly after being folded about an assembled connector, particularly when the ridges nearest the planar region are needed to engage the cross-bars. This curve would have the additional disadvantage that it might impinge on wires connected to the supported connector element 27. These undesirable effects are eliminated by the invention as a result of the permanent oblique bend applied to the flange 16 during the formation of the strap 10.

It is pointed out here that because the flange 16 is narrower than the planar region 11, only the flange 16 can enter the strap slot. The planar region cannot enter the strap slot 47 because of its increased width. Thus, the strap is prevented from entering the strap slot to an undesirable depth.

FIG. 5 illustrates an embodiment of the invention adapted to restrain a pair of connector elements neither of which are supported by other items, such as a chassis or electronic susbsystem housing. As a result, in this embodiment the rigid frame 30 is formed as a discrete element. The discrete rigid frame is an L-shaped plate, preferably formed of sheet metal. The elongate aperture **17*a* within which one of the connector elements is to be mounted is formed in one leg 25 of the plate. Located in the same leg along one side of the elongate aperture 17*a* (the side opposed to the other leg) are the holes 13*a* for receiving the anchoring prongs of the strap 10. Located along the same side of the elongate aperture is the positioning hole 15*a*. The other leg 23 of the rigid frame 13 includes slots 21*a*** formed between a series of cross-bars 22*a*. In order to illustrate that the leg or flange within which the slots and cross bars are formed can extend transversely in either direction with respect to the plane within which the elongate aperture is formed, FIG. 5 illustrates that the leg 23 extends toward the connector to be mated to the connector element mounted in the elongate aperture, as opposed to away from that connector. (In this regard, it will be recognized that the leg of the channel within which the cross bars 21 were formed in the embodiment of the invention illustrated in FIGS. 3 and 4 projected away from the mating connector element 24.) Regardless of which direction the cross-bar leg points in, the cross bars and slots form a ladder-like arrangement that latches the strap in place when the cross bars interact with the ridges of the flange of the strap 10 in the manner previously described.

FIG. 6 illustrates a connector block assembly including a retaining device formed in accordance with the invention. The connector block assembly includes a connector block 26, only a portion of which is shown in FIG. 6. The connector block 26 includes a plurality of quick connector elements 28. Quick connector elements, as will be readily recognized by those skilled in the art, include a pair of wedge-shaped blades formed such that a wire can be pressed between adjacent blades. When so pressed between adjacent blades by a suitable instrument, the insulation surrounding the wire is cut by the blades and the blades make contact with the blades. Wires extend from the blades 28, beneath the connector block 26, to a connector element 27*a* mounted in an aperture 17*b* formed in a flange 29 extending outwardly from the main portion of the connector block 26. Screws or bolts 37 attach the flange of the connector element 27*a* to the connector block flange 29. A strap 10, illustrated as folded over in FIG. 6, retains the connector elements together when a mating connector element 24*a* is attached to the supported connector element 27*a*. The mating connector 24*a* is affixed to one end of an electrical cable 39 in a conventional manner. The strap 10 is formed in the manner illustrated in FIGS. 1 and 2 and anchored to the flange 29 by pressing anchoring prongs into holes (not viewable in FIG. 6), located on one side of an elongate aperture 27*d* formed in the connector block flange 29. After being folded over the mated connector elements 24*a* and 27*a*, the strap flange 16 passes through a strap slot located along the other side of the elongate aperture 17*b*. A cross-bar 21 formed along the outer edge of the strap slot interacts with one of the teeth 18 to latch the strap in it retaining position. The single cross-bar 21 is integrally formed in the wall defining the outer edge of the connector block flange 29. As a result, the rigid frame is integrally formed in the connector block flange 29. Obviously, this same arrangement can be utilized with structures other than connector blocks, if desired.

As will be readily appreciated by those skilled in the art and others, many modifications and variations of the present invention are possible in light of the above teachings. It is therefore to be understood that, within the scope of the amended claims, the invention may be practiced otherwise than as specifically described herein.

The embodiments of the invention in which an exclusive property or privilege is claimed are defined as follows:

1. A retaining device for elongate electrical cable connectors comprising:

a. a strap formed of a semi-rigid, non-conductive material, said strap including a planar region having two opposing edges, integral anchoring means located along one of said opposing edges, and an integral ridged coupling means located along the other of said opposing edges; and, b. a rigid frame including an elongate aperture suitable for receiving one element of an elongate electrical cable connector, said rigid frame also including receiving means located on one side of said elongate aperture for receiving said anchoring means of said strap, said anchoring and said receiving means formed such that when said anchoring means is mounted in said receiving means said strap is affixed to said rigid frame, said rigid frame also including cross-bar coupling means located on the side of said aperture opposed to the side on which said receiving means is located for receiving and engaging said ridged coupling means of said strap.

2. A retaining device as claimed in claim 1 wherein said anchoring means of said strap includes at least one anchoring prong extending orthogonally outwardly from said one edge of said strap in the plane of said planar region and wherein said receiving means of said rigid frame includes at least one hole located along the related side of said elongate aperture in said rigid frame for receiving said at least one anchoring prong.

3. A retaining device as claimed in claim 2 wherein each of said anchoring prongs includes a bullet-shaped outer end that terminates prior to the related edge of said strap whereby a notch is formed between said bullet-shaped ends and said related edge of said strap.

4. A retaining device as claimed in claim 3 wherein each of said anchoring prongs is formed of two sections separated by a slot extending longitudinally through said anchoring prong.

5. A retaining device as claimed in claim 1 wherein said anchoring means includes a plurality of anchoring prongs extending orthogonally outwardly from said one edge of said strap in the plane of said planar region and wherein said receiving means of said rigid frame includes a plurality of holes located along the related side of said elongate aperture spaced from one another by distances corresponding to the distances between said anchoring prongs of said strap for receiving said plurality of anchoring prongs.

6. A retaining device as claimed in claim 5 wherein each of said anchoring prongs includes a bullet-shaped outer end that terminates prior to the related edge of said strap whereby a notch is formed between said bullet-shaped ends and said related edge of said strap.

7. A retaining device as claimed in claim 6 wherein each of said anchoring prongs is formed of two sections separated by a slot extending longitudinally through said anchoring prongs.

8. A retaining device as claimed in claim 7 including a positioning prong extending outwardly from the edge of said strap from which said anchoring prongs extend, in the plane of said planar region, said positioning prong being closer to one of said anchoring prongs and wherein said rigid frame includes a hole positioned so as to receive said positioning prong, said positioning prong adapted to position said strap such that said ridges lie on the side of said strap remote from said elongate aperture in said rigid frame.

9. A retaining device as claimed in claim 8 wherein said ridged coupling means of said strap includes a flange extending outwardly from said planar region and at least one ridge formed in said flange and lying along an axis lying parallel to the edge of said strap from which said flange extends.

10. A retaining device as claimed in claim 9 wherein said flange lies in a plane oblique to the plane of said planar region.

11. A retaining device as claimed in claim 10 wherein said cross-bar coupling means of said rigid frame includes at least one cross-bar positioned so as to interact with said at least one ridge and maintain said strap in a folded latched position.

12. A retaining device as claimed in claim 10 wherein said cross-bar coupling means of said rigid frame includes a ladder-like arrangement comprising a plurality of spaced parallel cross bars, said cross-bars adapted to interact with said at least one ridge and maintain said strap in a folded latched position.

13. A retaining device as claimed in claim 9 wherein said flange includes a plurality of parallel ridges formed in one surface of said flange, said parallel ridges lying along axes lying parallel to the edge from which said flange extends.

14. A retaining device as claimed in claim 13 wherein said flange lies in a plane oblique to the plane of said planar region.

15. A retaining device as claimed in claim 14 wherein said cross-bar coupling means of said rigid frame includes at least one cross-bar positioned so as to interact with one of said ridges and maintain said strap in a folded latched position.

16. A retaining device as claimed in claim 14 wherein said cross-bar coupling means of said rigid frame includes a ladder-like arrangement comprising a plurality of spaced parallel cross bars, said cross-bars adapted to interact with said ridges and maintain said strap in a folded latched position.

17. A retaining device as claimed in claim 1 wherein said ridged coupling means of said strap includes a flange extending outwardly from said planar region and at least one ridge formed in said flange and lying along an axis lying parallel to the edge of said strap from which said flange extends.

18. A retaining device as claimed in claim 17 wherein said flange includes a plurality of parallel ridges formed in one surface of said flange, said parallel ridges lying along axes lying parallel to the edge from which said flange extends.

19. A retaining device as claimed in claim 18 wherein said flange lies in a plane oblique to the plane of said planar region.

20. A retaining device as claimed in claim 17 wherein said flange lies in a plane oblique to the plane of said planar region.

21. A retaining device as claimed in claim 1 wherein said cross-bar coupling means of said rigid frame includes at least one cross-bar positioned so as to interact with said ridged coupling means.

22. A retaining device as claimed in claim 1 wherein said cross-bar coupling means of said rigid frame includes a ladder-like arrangement comprising a plurality of spaced parallel cross-bars, said cross-bars adapted to interact with said ridges and maintain said strap in a folded latched position.

23. An integral strap formed of a semi-rigid nonconducting material comprising:

a planar region having two opposing edges;

at least two anchoring prongs intergrally formed with said planar region and extending outwardly from said planar region in the plane of said planar region; and, a ridged flange integrally formed with said planar region and extending outwardly from the other edge of said planar region.

24. An integral strap as claimed in claim 23 wherein each of said anchoring prongs includes a bullet-shaped outer end that terminates prior to the related edge of said strap whereby a notch is formed between said bullet-shaped ends and said related edge of said strap.

25. An integral strap as claimed in claim 24 wherein each of said anchoring prongs is formed of two sections separated by a slot extending longitudinally through said anchoring prongs.

26. An integral strap as claimed in claim 25 including a positioning prong extending outwardly from the edge of said strap from which said anchoring prongs extend, in the plane of said planar region, said positioning prong being closer to one of said anchoring prongs than the other anchoring prong of said at least two anchoring prongs.

27. An integral strap as claimed in claim 26 wherein said ridged flange lies in a plane oblique to the plane of said planar region.

28. An integral strap as claimed in claim 26 wherein said ridged flange includes a plurality of parallel ridges formed in one surface of said flange, said parallel ridges lying along axes parallel to the edge from which said flange extends.

29. An integral strap as claimed in claim 28 wherein said ridged flange lies in a plane oblique to the plane of said planar region.

30. An integral strap as claimed in claim 23 including a positioning prong extending outwardly from the edge of said strap from which said anchoring prongs extend, in the plane of said planar region, said positioning prong being closer to one of said anchoring prongs than the other anchoring prong of said at least two anchoring prongs.

31. An integral strap as claimed in claim 23 wherein said ridged flange lies in a plane oblique to the plane of said planar region.

32. An integral strap as claimed in claim 23 wherein said ridged flange includes a plurality of parallel ridges formed in one surface of said flange, said parallel ridges lying along axes lying parallel to the edge from which said flange extends.

33. An integral strap as claimed in claim 32 wherein said ridged flange lies in a plane oblique to the plane of said planar region.

* * * * *